United States Patent [19]

Abbate

[11] Patent Number: 4,909,578

[45] Date of Patent: Mar. 20, 1990

[54] DISPLAY CASE

[75] Inventor: William S. Abbate, Fort Salonga, N.Y.

[73] Assignee: Structural Display, Inc., New York, N.Y.

[21] Appl. No.: 369,208

[22] Filed: Jun. 21, 1989

[51] Int. Cl.[4] ..... A47F 1/00

[52] U.S. Cl. ..... 312/45; 312/72; 312/73; 312/124

[58] Field of Search ..... 312/42, 45, 72, 73, 312/118, 60, 121, 124; D7/6

[56] References Cited

U.S. PATENT DOCUMENTS

| | | | |
|---|---|---|---|
| D. 254,530 | 3/1980 | Armstrong | 312/45 X |
| 317,678 | 5/1895 | Schombel | 312/124 |
| 659,225 | 10/1900 | Grau | 312/121 |
| 2,248,633 | 7/1941 | Lee | 312/124 X |
| 2,996,344 | 8/1961 | Garman | 312/45 |
| 4,037,756 | 7/1977 | Jaquish | 312/42 |

*Primary Examiner*—Joseph Falk
*Attorney, Agent, or Firm*—Daniel J. Tick

[57] ABSTRACT

A display case for storing and displaying a plurality of items of overall general elongated rolled and cylindrical configuration has a housing for accommodating a plurality of the items with their axes parallel to each other. The housing has a front, a back spaced from and parallel to the front, a pair of spaced parallel sides perpendicular to and joining the front and back, a top and a bottom spaced from and parallel to the top and perpendicular to the front, back and sides. An incline is formed in the housing on the bottom and back thereof and descends from the back to the front. A bottom opening is formed in front for accommodating the passage therethrough of one of the items at a time. The bottom opening extends from one of the sides to the other of the sides and from a first line spaced from and parallel to the bottom to an intermediate line spaced from and parallel to the first line whereby items in the housing are prevented from rolling out of the bottom opening, but may be manually lifted therethrough. Ledges extend from the bottom of the housing beyond the front for supporting and exhibiting one of the items outside the housing. A top opening is formed in the front for accommodating the placing of a plurality of the items in the housing. The top opening extends from one of the sides to the other of the sides and from the top to the intermediate line, whereby items may be placed in the housing. A door is movably affixed to the sides of the housing for covering the top opening in its closed position and for leaving the top opening unobstructed in its open position. A latch is provided in the housing adjacent the front thereof for maintaining the door in its closed position. A ramp in the housing is affixed to and extends between the sides thereof perpendicularly to the sides and at an angle with the bottom. The ramp descends from an area spaced from the front of the housing to an area spaced from the back of the housing whereby items placed in the housing through the top opening roll down the ramp onto the incline whence the items roll to the bottom opening.

6 Claims, 2 Drawing Sheets

DISPLAY CASE

BACKGROUND OF THE INVENTION

The present invention relates to a display case. More particularly, the invention relates to a display case for storing and displaying a plurality of overall general elongated rolled and/or cylindrical items.

The storage and display of elongated rolled and/or cylindrical items such as, for example, wallpaper has been and is far from satisfactory. The rolls of wallpaper are usually stored on shelves in a manner whereby they cannot be displayed or seen unless they are removed from such shelves. This is not conducive to arousing interest in the wallpaper and certainly does not encourage sales thereof.

The principal object of the invention is to provide a display case which stores and displays elongated rolled and/or cylindrical items such as, for example, wallpaper, in a manner which is attractive and convenient to prospective consumers.

An object of the invention is to provide a display case which stores and displays elongated rolled and/or cylindrical items in a manner which facilitates examination and handling of the items and therefore encourages interest in and sales of such items.

Another object of the invention is to provide a display case of simple structure which is used with facility and convenience for storing and displaying elongated rolled and/or generally cylindrical items in an attractive manner.

BRIEF SUMMARY OF THE INVENTION

In accordance with the invention, a display case for storing and displaying a plurality of items of overall general elongated rolled and cylindrical configuration, each having an axis, a housing for accommodating a plurality of the items with their axes substantially parallel to each other. The housing has a front, a back spaced from and substantially parallel to the front, a pair of spaced substantially parallel sides substantially perpendicular to and joining the front and back, a top and a bottom spaced from and substantially parallel to the top and substantially perpendicular to the front, back and sides. An incline is formed in the housing on the bottom and back thereof and descends from the back to the front. A bottom opening is formed in the front for accommodating the passage therethrough of one of the items at a time. The bottom opening extends substantially from one of the sides to the other of the sides and from a first line spaced from and substantially parallel to the bottom to an intermediate linen spaced from and substantially parallel to the first line whereby items in the housing are prevented from rolling out of the bottom opening, but may be manually lifted therethrough. Ledge means extends from the bottom of the housing beyond the front for supporting and exhibiting one of the items outside the housing. A top opening is formed in the front for accommodating the placing of a plurality of the items in the housing. The top opening extends substantially from one of the sides to the other of the sides and from the top to substantially the intermediate line, whereby items may be placed in the housing. A door is movably affixed to the sides of the housing for covering the top opening in its closed position and for leaving the top opening unobstructed in its open position. Latch means is provided in the housing adjacent the front thereof for maintaining the door in its closed position. A ramp in the housing is affixed to and extends between the sides thereof substantially perpendicularly to the side and at an angle with the bottom. The ramp descends from an area spaced from the front of the housing to an area spaced from the back of the housing whereby items placed in the housing through the top opening roll down the ramp onto the incline whence the items roll to the bottom opening.

The incline descends in an exponential curve and is at an angle of approximately 12 degrees with the bottom for a portion of its length from the front to closer to the back than midway thereto.

The ledge means comprises a pair of spaced substantially partially curved ledges extending from the bottom of the housing beyond the front, each of the ledges having a lip formed therein in spaced substantially parallel relation with the front for supporting one of the items between them.

The door is affixed to the sides of the housing at substantially the intermediate line and opens outward away from the front of the housing at the top thereof.

The door has magnetic means thereon and the latch means comprises magnetic latch means in the housing at the top thereof and in operative proximity with the magnetic means of the door.

The ramp is at an angle of approximately 12 degrees with the bottom.

The housing is composed of transparent material.

In accordance with the invention, a display case for storing and displaying a plurality of items of overall general elongated rolled and cylindrical configuration, each having an axis, comprises a housing of transparent material for accommodating a plurality of the items with their axes substantially parallel to each other, the housing having a front, a back spaced from and substantially parallel to the front, a pair of spaced substantially parallel sides substantially perpendicular to and joining the front and back, a top and a bottom spaced from and substantially parallel to the top and substantially perpendicular to the front, back and sides. An incline formed in the housing on the bottom and back thereof and descending from the back to the front in an exponential curve, is at an angle of approximately 12 degrees with the bottom for a portion of its length from the front to closer to the back than midway thereto. A bottom opening is formed in the front for accommodating the passage therethrough of one of the items at a time, the bottom opening extending substantially from one of the sides to the other of the sides and from a first line spaced from and substantially parallel to the bottom to an intermediate line spaced from and substantially parallel to the first line whereby items in the housing are prevented from rolling out of the bottom opening, but may be manually lifted therethrough. Substantially partially curved ledge means extending from the bottom of the housing beyond the front comprises a pair of spaced substantially partially curved ledges each having a lip formed therein in spaced substantially parallel relation with the front for supporting and exhibiting one of the items between the ledges outside the housing. A top opening formed in the front for accommodating the placing of a plurality of the items in the housing extends substantially from one of the sides to the other of the sides and from the top to substantially the intermediate line whereby items may be placed in the housing. A door movably affixed to the sides of the housing at substantially the intermediate line for covering the top opening in its closed position and for leaving the top opening unobstructed in its open position, opens outward away from the front of the housing at the top thereof. The door has magnetic components thereon. Magnetic latch means in the housing at the top thereof adjacent the front thereof and in operative proximity with the magnetic components of the door maintains the door in its closed position. A ramp in the housing affixed to and extending between the sides thereof substantially perpendicular to the sides and at an angle of approximately 12 degrees with the bottom, descends from an area spaced from the front of the housing to an area spaced from the back of the housing whereby items placed in the housing through the top opening roll down the ramp onto the incline whence the items roll to the bottom opening.

BRIEF DESCRIPTION OF THE DRAWINGS

In order that the invention may be readily carried into effect, it will now be described with reference to the accompanying drawings, wherein.

DETAILED DESCRIPTION OF A PREFERRED EMBODIMENT

Figure 1:
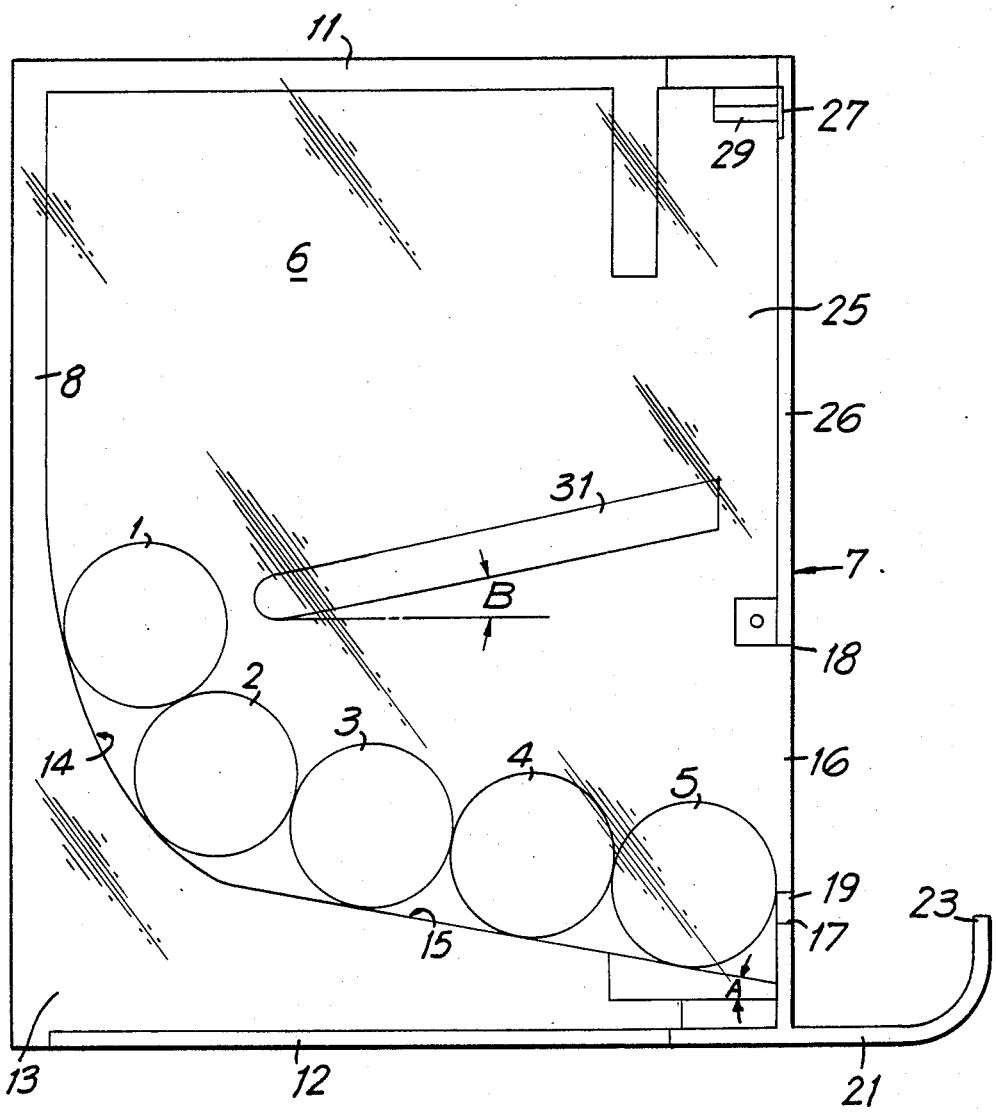
FIG. 1 is a cross-sectional view of an embodiment of the display case of the invention.
Figure 2:
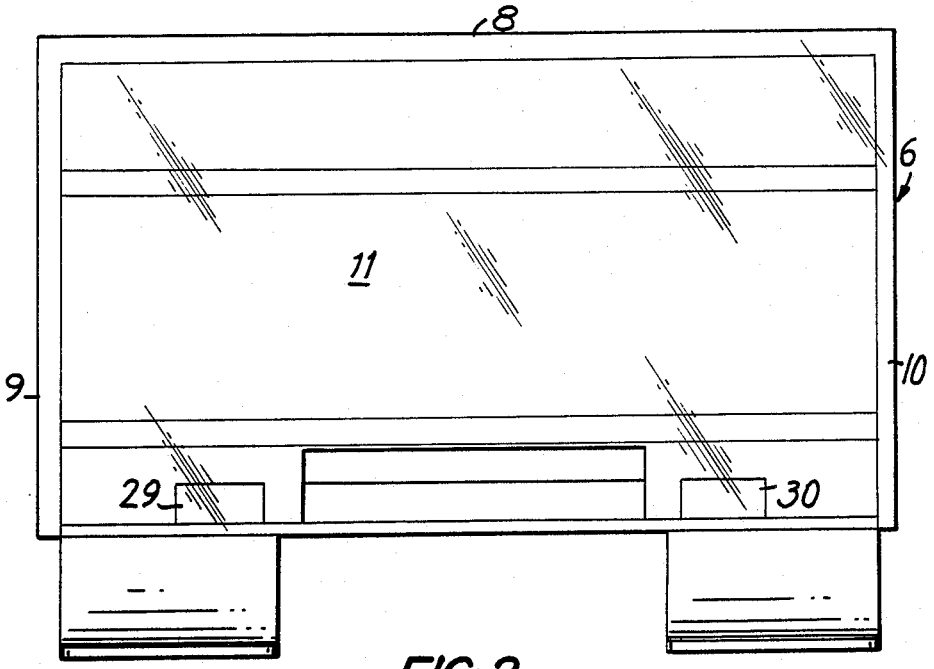
FIG. 2 is a plan view, on a reduced scale, of the embodiment of FIG. 1.
Figure 3:
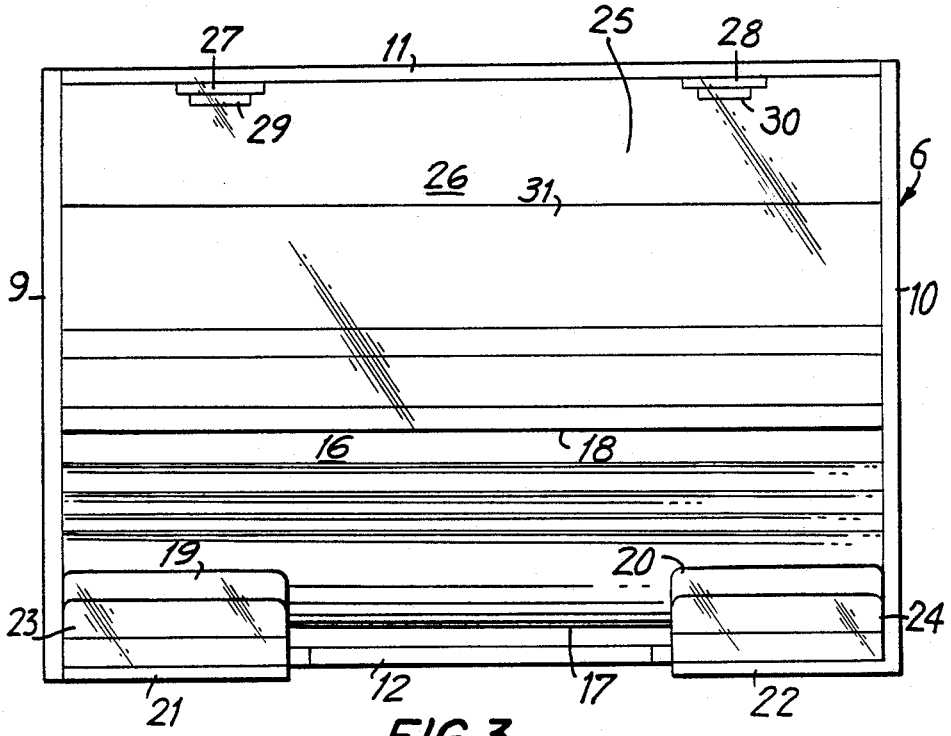
FIG. 3 is a front view, on a reduced scale, of the embodiment of FIG. 1.

The display case of the invention, as shown in FIGS. 1 to 3, stores and displays a plurality of items 1, 2, 3, 4 and 5, shown in FIG. 1 in phantom, of overall general elongated rolled and cylindrical configuration such as, for example, rolls of wallpaper. Each of the items 1 to 5 has an axis, shown in FIG. 1.

The case of the invention comprises a housing 6 of transparent material of any suitable type such as, for example, plastic material or Plexiglass, for accommodating a plurality of the items 1 to 5, and others, with their axes substantially parallel to each other. The housing 6 has a front 7 (FIGS. 1 and 2), a back 8 spaced from and substantially parallel to said front (FIG. 1) and a pair of spaced substantially parallel sides 9 and 10 substantially perpendicular to and joining said front and back (FIG. 3). The housing 6 also has a top 11 (FIGS. 1, 2 and 3) and a bottom 12 spaced from and substantially parallel to said top and substantially perpendicular to the front, back and sides (FIGS. 1 and 3).

An incline 13 (FIG. 1) is formed in the housing 6 on the bottom 12 and back 8 thereof and descends, as shown in FIG. 1, from said back to the front 7 in an exponential curve 14 (FIG. 1). The incline 13 is at an angle A of approximately 12 degrees with the bottom 12 for a portion 15 of its length from the front 7 to closer to the back 8 than midway thereto, as shown in FIG. 1.

A bottom opening 16 is formed in the front 7 (FIGS. 1 and 3) for accommodating the passage therethrough of one of the items 1 to 5 at a time. The bottom opening 15 extends substantially from one of the sides 9 and 10 to the other of the sides, as shown in FIG. 3, and from a first line 17 (FIGS. 1 and 3) spaced from and substantially parallel to the bottom 12 to an intermediate line 18 (FIGS. 1 and 3) spaced from and substantially parallel to said first line. Portions 19 and 20 of the front 7 (FIG. 3) thereby prevent items 1 to 5 in the housing 6 from rolling out of the bottom opening 16, but permit such items to be manually lifted through said bottom opening.

A pair of spaced substantially partially curved ledges 21 and 22 extend from the bottom 12 of the housing 6 beyond the front 7 (FIGS. 2 and 3). The ledges 21 and 22 have lips 23 and 24, respectively, formed therein in spaced substantially parallel relation with the front 7, as shown in FIG. 2. The ledges 21 and 22 support and exhibit one of the items 1 to 5 between them outside the housing 6.

A top opening 25 is formed in the front 7 (FIG. 3) of the housing 6 for accommodating the placing of a plurality of the items 1 to 5 in said housing. The top opening 25, as shown in FIG. 3, extends substantially from the side 9 to the side 10 and from the top 11 to substantially the intermediate line 18 whereby items may be placed in the housing 6.

A door 26 (FIGS. 1, 2 and 3) is movably affixed to the sides 9 and 10 of the housing 6 at substantially the intermediate line 18 for covering the top opening 25 in its closed position, as shown in the FIGS., and for leaving said top opening unobstructed in its open position. The door 26 opens outward away from the front 7 of the housing 6 at the top 11 thereof.

The door has magnetic components 27 and 28 thereon (FIG. 3). A magnetic latch is provided in the housing 6 at the top 11 thereof adjacent the front 7 thereof. The latch consists of a pair of spaced magnetic members 29 and 30 in operative proximity with the magnetic components 27 and 28, respectively, of the door 26, as shown in FIG. 3, for maintaining said door in its closed position, as shown in the FIGS.

A ramp 31 (FIG. 1) is provided in the housing 6 affixed to and extending between the sides 9 and 10 of said housing substantially perpendicularly to said sides and at an angle B of approximately 12 degrees with the bottom 12. The ramp 31 descends from an area spaced from the front 7 of the housing 6 to an area spaced from the back 8 of said housing, as shown in FIG. 1. Thus, items 1 to 5, and others, placed in the housing 6 through the top opening 25 roll down the ramp 31 onto the incline 13 whence said items roll to the bottom opening 16, where they are available, one at a time, for removal from said housing.

Although shown and described in what is believed to be the most practical and preferred embodiment, it is apparent that departures from the specific housing described and shown will suggest themselves to those skilled in the art and may be made without departing from the spirit and scope of the invention. I, therefore, do not wish to restrict myself to the particular construction described and illustrated, but desire to avail myself of all modifications that may fall within the scope of the appended claims.

I claim:

1. A display case for storing and displaying a plurality of items of overall general elongated rolled and cylindrical configuration, each having an axis, said case comprising a housing for accommodating a plurality of said items with their axes substantially parallel to each other, said housing having a front, a back spaced from and substantially parallel to said front, a pair of spaced substantially parallel sides substantially perpendicular to and joining said front and back, a top and a bottom spaced from and substantially parallel to said top and substantially perpendicular to said front, back and sides;

an incline formed in said housing on the bottom and back thereof and descending from said back to said front in an exponential curve and at an angle of approximately 12 degrees with said bottom for a portion of its length from said front to closer to said back than midway thereto;

a bottom opening formed in said front for accommodating the passage therethrough of one of said items at a time, said bottom opening extending substantially from one of said sides to the other of said sides and from a first line spaced from and substantially parallel to said bottom to an intermediate line spaced from and substantially parallel to said first line whereby items in said housing are prevented from rolling out of said bottom opening, but may be manually lifted therethrough;

ledge means extending from the bottom of said housing beyond said front for supporting and exhibiting one of said items outside said housing;

a top opening formed in said front for accommodating the placing of a plurality of said items in said housing, said top opening extending substantially from one of said sides to the other of said sides and from said top to substantially said intermediate line whereby items may be placed in said housing;

a door movably affixed to the sides of said housing at substantially said intermediate line for covering said top opening in its closed position and for leaving said top opening unobstructed in its open position, said door opening outward away from said front of said housing at said top thereof;

latch means in said housing adjacent said front thereof for maintaining said door in its closed position; and a ramp in said housing affixed to and extending between the sides thereof substantially perpendicularly to said sides and at an angle with said bottom, said ramp descending from an area spaced from said front of said housing to an area shaped from said back of said housing whereby items placed in said housing through said top opening roll down said ramp onto said incline whence said items roll to said bottom opening.

2. A display case as claimed in claim 1, wherein said ledge means comprises a pair of spaced substantially partially curved ledges extending from the bottom of said housing beyond said front, each of said ledges having a lip formed therein in spaced substantially parallel relation with said front for supporting one of said items between them.

3. A display case as claimed in claim 1, wherein said door has magnetic means thereon and said latch means comprises magnetic latch means in said housing at the top thereof and in operative proximity with the magnetic means of said door.

4. A display case as claimed in claim 1, wherein said ramp is at an angle of approximately 12 degrees with said bottom.

5. A display case as claimed in claim 1, wherein said housing is composed of transparent material.

6. A display case for storing and displaying a plurality of items of overall general elongated rolled and cylindrical configuration, each having an axis, said case comprising a housing of transparent material for accommodating a plurality of said items with their axes substantially parallel to each other, said housing having a front, a back spaced from and substantially parallel to said front, a pair of spaced substantially parallel sides substantially perpendicular to and joining said front and back, a top and a bottom spaced from and substantially parallel to said top and substantially perpendicular to said front, back and sides;

an incline formed in said housing on the bottom and back thereof and descending from said back to said front in an exponential curve, said incline being at an angle of approximately 12 degrees with said bottom for a portion of its length from said front to closer to said back than midway thereto;

a bottom opening formed in said front for accommodating the passage therethrough of one of said items at a time, said bottom opening extending substantially from one of said sides to the other of said sides and from a first line spaced from and substantially parallel to said bottom to an intermediate line spaced from and substantially parallel to said first line whereby items in said housing are prevented from rolling out of said bottom opening, but may be manually lifted therethrough;

substantially partially curved ledge means extending from the bottom of said housing beyond said front, said ledge means comprising a pair of spaced substantially partially curved ledges each having a lip formed therein in spaced substantially parallel relation with said front for supporting and exhibiting one of said items between said ledges outside said housing;

a top opening formed in said front for accommodating the placing of a plurality of said items in said housing, said top opening extending substantially from one of said sides to the other of said sides and from said top to substantially said intermediate line whereby items may be placed in said housing;

a door movably affixed to the sides of said housing at substantially said intermediate line for covering said top opening in its closed position and for leaving said top opening unobstructed in its open position, said door opening outward away from said front of said housing at said top thereof, said door having magnetic components thereon;

magnetic latch means in said housing at the top thereof adjacent said front thereof and in operative proximity with the magnetic components of said door for maintaining said door in its closed position; and a ramp in said housing affixed to and extending between the sides thereof substantially perpendicuarly to said sides and at an angle of approximately 12 degrees with said bottom, said ramp descending from an area spaced from said front of said housing to an area spaced from said back of said housing whereby items placed in said housing through said top opening roll down said ramp onto said incline whence said items roll to said bottom opening.

* * * * *